United States Patent [19]

Grimsley

[11] Patent Number: 4,651,497

[45] Date of Patent: Mar. 24, 1987

[54] APPARATUS FOR PACKAGING A PRESSURIZED DISPENSER

[75] Inventor: Arvid K. Grimsley, Greenwich, Conn.

[73] Assignee: Goodway Tools Corporation, Stamford, Conn.

[21] Appl. No.: 730,291

[22] Filed: May 3, 1985

[51] Int. Cl.[4] ..... B65B 31/00

[52] U.S. Cl. ..... 53/101; 53/281; 53/88; 53/109; 53/470; 141/27; 141/98; 141/113

[58] Field of Search ..... 53/79, 86, 89, 85, 101, 53/103, 106, 108, 109, 470, 471, 281, 320, 366, 88; 141/2, 3, 5, 20, 27, 98, 113

[56] References Cited

U.S. PATENT DOCUMENTS

| | | | |
|---|---|---|---|
| 3,204,387 | 9/1965 | Scheindel | 53/470 X |
| 3,224,158 | 12/1965 | Baumann | 53/470 X |
| 3,516,224 | 6/1970 | Caccini | 53/109 X |
| 3,545,170 | 12/1970 | Leonard | 53/109 X |
| 3,673,762 | 7/1972 | Bock et al. | 53/86 |
| 3,755,985 | 9/1973 | Rait et al. | 53/470 X |
| 3,783,576 | 1/1974 | Riesenberg et al. | 53/470 X |
| 3,897,672 | 8/1975 | Scheindel | 53/470 |
| 3,995,666 | 12/1976 | Michaels | 141/3 |
| 4,150,522 | 4/1979 | Burger | 53/470 |

*Primary Examiner*—John Sipos
*Assistant Examiner*—Steven P. Weihrouch
*Attorney, Agent, or Firm*—Jacobs & Jacobs

[57] ABSTRACT

Apparatus for packaging product in an inverted, open bottom piston-type pressurized dispenser has a mechanism for pressurizing the container above the piston and for inserting a bottom closure on the open bottom and connecting it to the container body to close the open bottom.

7 Claims, 8 Drawing Figures

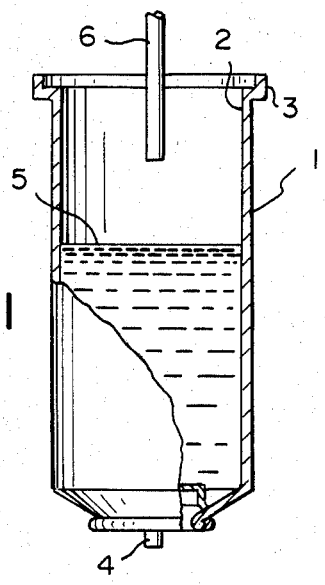
FIG. 1
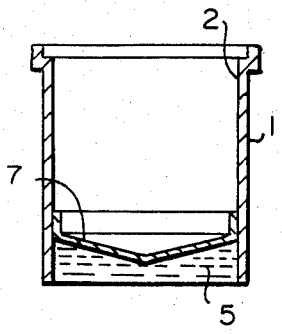
FIG. 2
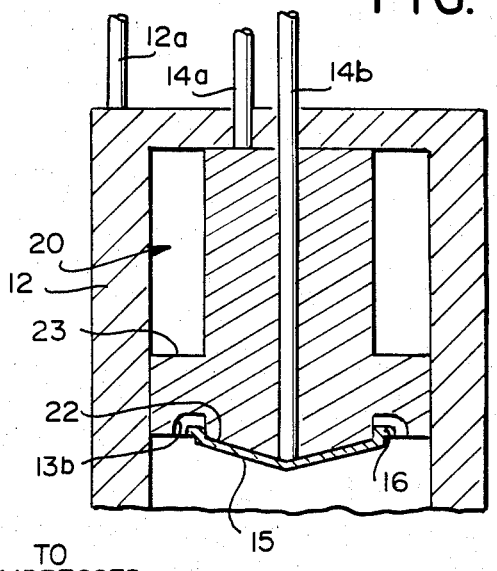
FIG. 6
FIG. 7
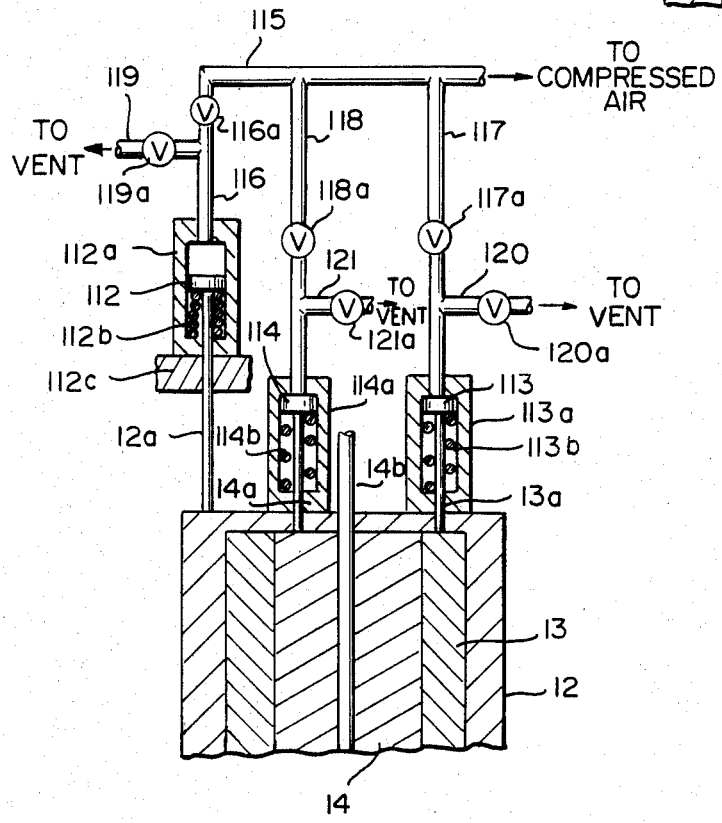
FIG. 8
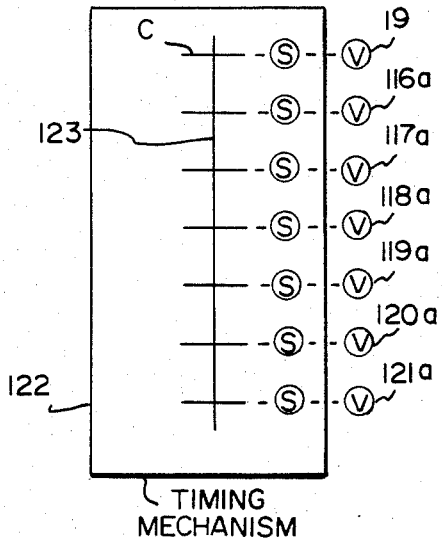

APPARATUS FOR PACKAGING A PRESSURIZED DISPENSER

The present invention relates to a method and apparatus for filling and assembling a piston-type pressurized dispensing container.

Containers are known in which the product therein is maintained under and dispensed by a gas pressure exerted against an internal piston in intimate contact with the product. Prior art methods and apparatus for filling and assembling piston-type pressurized dispensing containers are illustrated in Scheindel, U.S. Pat. No. 3,204,387 and Baumann, U.S. Pat. No. 3,224,158. In the Scheindel patent, the piston is inserted into the container through the open bottom thereof and a bottom closure is attached through interfolding flange portions of the bottom closure and the container to produce a double seam. Product is introduced through an opening in the top of the container and the opening closed with a dispensing valve. A vent hole is then provided in the bottom closure and the space between the piston and the bottom closure is pressurized, and the vent hole is sealed.

In Baumann, the dispensing valve is secured to the container while the container is empty. The container is inverted and product is introduced into the container through the open bottom thereof, after which the piston is inserted and the bottom closure is attached to the container through interfolding flange portions. Baumann also uses a vent hole in the bottom closure through which pressurized gas is introduced.

The present invention provides an improved method and apparatus for filling and assembling pistontype pressurized dispensers. In accordance with the present invention, the need for a vent hole in the bottom closure is avoided, and instead the container is pressurized and the bottom closure attached to the container body at a single station of a filling apparatus, which comprises means for pressurizing the space within the container body and above the piston and means for sealing a container bottom closure to the container body, thereby closing the open bottom of the container body.

The present invention is illustrated in terms of its preferred embodiments in the accompanying drawings, in which:

FIG. 1 is an elevational view, partly in section, of an inverted container body after the filling operation has been completed;

FIG. 2 is a view in elevation, in section, illustrating the insertion of a piston into a filled container body;

FIG. 6 is a detail view of an alternative embodiment of the invention;

FIG. 7 is a schematic view of a fluid pressure system used in the present invention; and FIG. 8 is a schematic view of a timing mechanism used to operate the present invention.

Figure 3:
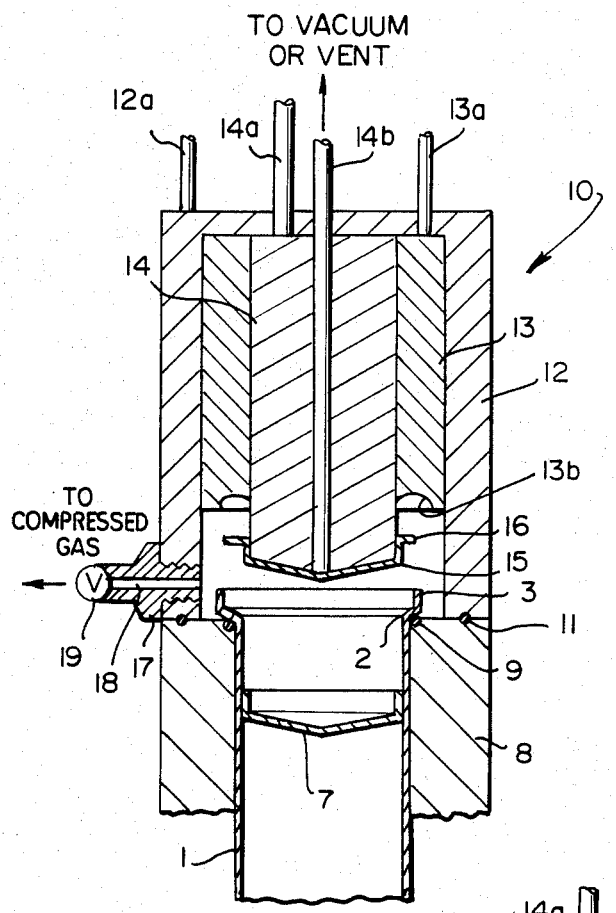
FIG. 3 is an elevational view, in section, of the apparatus of the present invention for pressurizing and sealing the container body showing the introduction of pressurized gas.

With reference to FIG. 1, the inverted container body 1 has an open bottom 2 provided with a flange 3. The top of the container body 1 is provided with a conventional dispensing valve 4. Container body 1, while in the inverted position shown in FIG. 1, is filled with product 5 through the conduit 6 of a filling mechanism (not shown). Filling mechanisms for dispensing product into a pressurized dispensing container are well known in the art and, as is known, include means for holding the container body 1 in an inverted position and metering and timing means for injecting the product into the container body 1.

FIG. 2 shows the container body 1 after the piston 7 has been inserted through the open bottom 2 into contact with the product 5. Here again, mechanisms for inserting a piston into pressurized dispensing containers are well known in the art.

Figure 4:
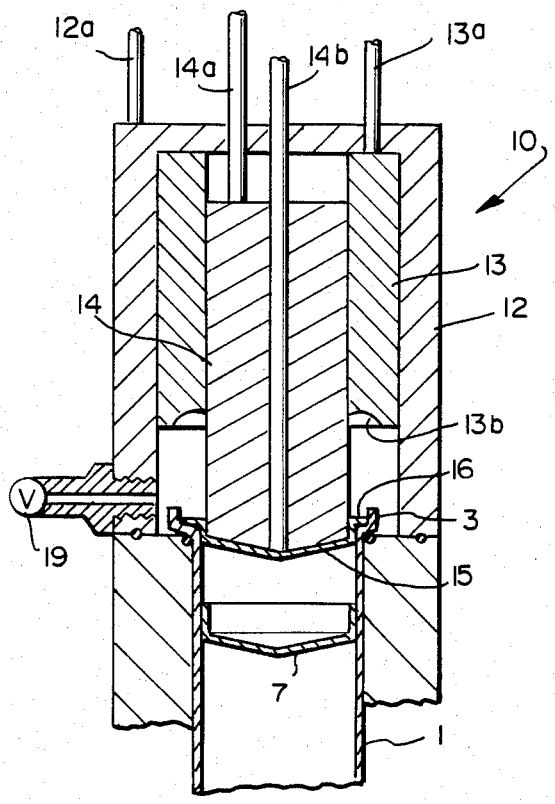
FIG. 4 is an elevational view, in section, similar to FIG. 3, showing the insertion of the bottom closure into the container.
Figure 5:
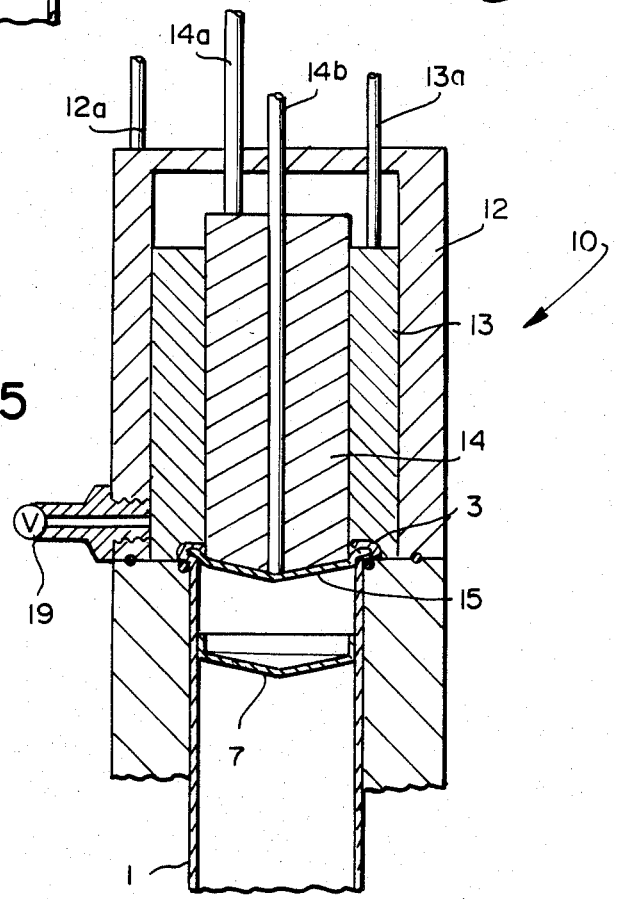
FIG. 5 is an elevational view., in section, similar to FIG. 3, showing the sealing of the bottom closure to the container body.

FIGS. 3–5 illustrate various stages of operation of the mechanism 10 according to the present invention for pressurizing the container and sealing a bottom closure thereto. In particular, as seen in FIG. 3, in the first stage of operation, the inverted container body 1 is held within a fixture 8 in inverted position. A suitable sealing member 9, such as an O-ring, is carried by the fixture 8 to provide a fluid seal between the flange 3 and fixture 8. Mechanism 10 abuts against the upper end of Fixture 8 and in contact with the sealing member 11, such as an O-ring, to provide a fluid seal between the mechanism 10 and fixture 8. In particular, mechanism 10 comprises an outer cylinder 12 having a closed top and an open bottom. Within the cylinder 12 are a cylindrical tube 13 and a rod or plug 14, the members 12, 13 and 14 being arranged in sliding movement with respect to one another in a manner to be described in detail hereinafter.

Members 12, 13 and 14 are connected to operating rods 12*a*, 13*a* and 14*a*, respectively. Member 14 operates to insert bottom closure 15 into the open bottom 2 of the container body 1. To this end, bore 14*b* is connected to a two position valve connected to a source of vacuum and an atmospheric vent, none of which are shown. Thus, with the valve in one position, member 14 is vented to the atmosphere and in the alternate position member 14 is in communication with the vacuum source. The synchronization of the operation of the inserter 14 with the cylceof mechanism 10 is well known in the art.

Mechanism 10 also includes a gas inlet 17 having a bore 18 communicating with the interior of the inverted, cup-like member 12, and a valve 19 is provided to control the admission of pressurized gas through the gas inlet 17 in a manner to be described in detail hereinafter.

FIG. 3 shows the mechanism 10 after the operating rod 12*a* has moved the mechanism 10 into contact with the fixture 8. In this position, the space within the interior of the inverted cup-like member 12 and the space within the interior of the container body 1 and above the piston 7 is gas-tight by means of the seals 9 and 11. Valve 19 is connected to a source of compressed gas (not shown) and when valve 19 opens, the compressed gas flows through valve 19 and into the space above the piston 7 by means of the bore 18. FIG. 4 shows the next stage of operation of mechanism 10, wherein valve 19 is closed and operating rod 14*a* is caused to move downwardly so that the bottom closure 15 is inserted into the open bottom 2 of the container 1 with the flanges 3 and 16 in contact with one another. In this stage of the operation of mechanism 10, the space between the piston 7 and bottom closure 15 is pressurized and the space within the interior of the inverted cup-like member 12 is also pressurized.

In FIG. 5, the cylindrical tube 13 has been moved downwardly to the position shown in FIG. 5 by means of the operating member 13*a*. The annular groove 13*b* at the end of the cylindrical tube 13 (FIGS. 3 and 4) crimps the flanges 3 and 16 together in interfolded relationship to seal the bottom 2 of the container body 1. Bore 14*b* is then disconnected from the source of vacuum and connected to vent so as to release closure 15. The pressurizing and sealing operations have now been completed by the mechanism 10 and operating rods 12*a*, 13*a* and 14*a* then move the members 12, 13 and 14, respectively, to their initial position (not shown) in which members 13 and 14 are located with respect to one another and to member 12 in the relationship shown in FIG. 3, and in which member 12 is moved upwardly, as viewed in FIG. 3, and away from the fixture 8. Container 1 in its completed form, is then removed from fixture 8 in a conventional manner.

FIG. 6 shows an alternative embodiment of the invention in which the member 20 replaces the members 13 and 14. Thus, member 20 has the main body portion 21 having a centrally located bore 14*b* therethrough. The bottom end 22 of member 21 will carry the bottom closure 15 in the same way as it is carried by member 14. Similarly, the operating rod 14*a* will move the member 20 in the same way that operating rod 14*a* moves the member 14. Spaced from the bottom end 22 is a circular flange 23 having an annular groove 13*b*. The outer cylindrical wall of the flange 23 contacts the inner cylindrical wall of member 12 in the same way that members 12 and 13 (FIG. 3) contact each other. Through the use of the member 20, the bottom closure 15 is simultaneously inserted into the open bottom 2 of the container body 1 and the flanges 3 and 16 are crimped together by means of the annular groove 13*b*.

FIGS. 7 and 8 illustrate how the operation of the mechanism 10 is controlled. With reference to FIG. 7, operating rods 12*a*, 13*a* and 14*a* are connected to pistons 112, 113 and 114, respectively, which operate in fluid pressure cylinders 112*a*, 113*a* and 114*a*, respectively. A source of compressed air is connected to the inlet of each cylinder 112*a*, 113*a* and 114*a* by means of main conduit 115 and branches 116, 117 and 118, respectively. Cylinders 112*a*, 113*a* and 114*a* are vented to the atmosphere by means of conduits 119, 120 and 121. Valves 116*a* through 121*a* are located in the conduits 116 through 121 to connect the cylinders 112*a*, 113*a* and 114*a* to the source of compressed air or to vent the cylinders, as desired.

The timing mechanism 122 (FIG. 8) comprises a shaft 123 carrying seven edge cams C that are operatively associated with seven switches S in a conventional manner. In turn, the switches S are each operatively connected to one of the valves 19 or 116*a* through 121*a*. A mctor (not shown) rotates shaft 123 and the various cams C open and close the switches S in the desired sequence so as to open and close valve 19 and valve 116*a* through 121*a* in the desired sequence.

As seen in FIG. 7, cylinder 112*a* is mounted on support 112*c* so that extension of rod 12*a* out of cylinder 112*a* will cause members 12, 13 and 14 to move downwardly (as viewed in FIGS. 3 and 7) as a unit to the position shown in FIG. 3. Members 12, 13 and 14 also move together upwardly when rod 12*a* is retracted into the cylinder 112*a*. However, since fluid cylinders 113*a* and 114*a* are mounted on the inverted, cup-like member 12, rods 13*a* and 14*a* can move members 13 and 14 relative to one another and to member 12 as rods 13*a* and 14*a* are extended from or are retracted into cylinders 113*a* and 114*a*, respectively. Rods 12*a*, 13*a* and 14*a* are extended from their respective cylinders by fluid acting on pistons 112, 113, 114 when vent valves 119*a*, 120*a*, 121*a* are closed and valves 116*a*, 117*a*, 118*a* are open, and they are retracted into their respective cylinders by springs 112*c*, 113*c* and 114*c*, repsectively, when valves 116*a*, 117*a*, 118*a* are closed and vent valves 119*a*, 120*a*, 121*a* are open.

In the initial position of mechanism 10 (not shown), vent valves 119*a*, 120*a*, 121*a* are open and all other valves are closed. Vent valve 119*a* is then closed and valve 116*a* is opened to extend rod 12*a* out of cylinder 112*a*, thereby moving members 12, 13, 14 to the position shown in FIG. 3, whereupon valve 19 is opened to pressurize container body 1 above piston 7. Vent valve 121*a* is then closed and valve 118*a* opened to move member 14 downwardly to the position shown in FIG. 4, after which vent valve 120*a* is closed and valve 117*a* opened to move member 13 downwardly to the position shown in FIG. 5. Bore 14*b* is then switched from vacuum to vent to release bottom closure 15 from member 14. Valves 116*a*, 117*a*, 118*a* are then closed and vent valves 119*a*, 120*a*, 121*a* opened to allow springs 112*b*, 113*b*, 114*b* to retract rods 12*a*, 13*a*, 14*a* into their respective cylinders thereby separating member 12 from fixture 8 and restoring members 13 and 14 to their initial position. and 14, cylinder 113*a* and its associated valves will not be used, since rod 14*a* operates to move member 20.

The present invention lends itself to pressurizing and sealing piston-type dispensers for any product, but it is particularly useful for toothpaste dispensers, since piston-type dispensers for toothpaste offer many advantages over the toothpaste pumps now being marketed.

I claim:

1. An apparatus for packaging product in an open-bottom container body having a product dispensing valve at the top thereof, which comprises support means for holding the container body in an inverted position, means for filling said inverted container body with product through said open bottom while said container body is held by said support means, means for inserting a piston in said open bottom and into contact with said product, and a chamber having an open end and a closed end, said chamber being movable between a normal retracted position in which it is spaced from said support means and an extended operating position in which said open end contacts said support means and surrounds said support bottom of said container body supported by said support means, means for admitting pressurized gas into said chamber and above said piston when said charber is at its operating position, whereby pressurized gas is admitted into said container body above said piston, and container bottom closure inserter and sealing means within said chamber for inserting a container bottom closure into contact with the perimeter of the open bottom of said pressurized container body and for sealing said container bottom closure to the perimeter of said bottom of said container body while said container body is pressurized.

2. An apparatus for packaging product in an openbottom container body having a product dispensing valve at the top thereof, which comprises support means for holding the container body in an inverted position;

means for filling said inverted container body with product through said open bottom while said container body is held by said support means; means for inserting a piston in said open bottom and into contact with said product; a chamber having an open end and a closed end, said chamber being movable between a normal retracted position in which it is spaced from said support means and an extended operating position in which said open end contacts said support means and surrounds said open bottom of said container body supported by said support means; means for admitting pressurized gas into said chamber and above said piston when said chamber is at its operating position, whereby pressurized gas is admitted into said container body above said piston; and container bottom closure inserter and sealing means within said chamber for inserting a container bottom closure into contact with the perimeter of the open bottom of said pressurized container body and for sealing said container bottom closure to the perimeter of said bottom of said container body while said container body is pressurized; said container bottom closure inserter and sealing means comprising a container bottom inserter member within said chamber and having first and second ends disposed adjacent said open and closed ends, respectively, of said chamber and a crimping member within said chamber and around said inserter member and having a first end adajcent said first end of said inserter member and a second end adajcent said closed end of said chamber; said crimping member and said inserter member each being movable between a normal retracted position in which said first ends thereof are remote from said chamber open end and an extended operating position in which said first ends are extended towards said chamber open end; said first end of said inserter member being operable to carry a container bottom closure and to insert said container bottom closure on the perimeter of the open bottom of said container body when at said inserter member operating position; said crimping member being operable to crimp together a said container bottom closure and said open end of said container body along the perimeter thereof during extension thereof toward said operating position; and moving means is provided for extending and retracting said chamber, said crimping member and said inserter member, said moving means being operable to extend said crimping member and said inserter member after said pressurized gas is admitted into said chamber.

3. Apparatus according to claim 2, wherein said inserter member is cylindrical and said crimping member is a ring surrounding said cylindrical inserter member.

4. Apparatus according to claim 3, wherein said inserter and crimping members are integral.

5. Apparatus according to claim 3, wherein said inserter and crimping members are movable with respect to one another.

6. Apparatus according to claim 3, wherein said chamber is cylindrical, and said inserter and crimping members are movable with respect to one another and to said chamber.

7. Apparatus according to claim 4, wherein said chamber is cylindrical and said inserter and crimping members are movable with respect to said chamber.

* * * * *